United States Patent [19]

Irvine

[11] 4,067,568

[45] Jan. 10, 1978

[54] DOCUMENT FEEDING AND STACKING APPARATUS

[75] Inventor: Robert Irvine, Stamford, Conn.

[73] Assignee: Pitney-Bowes, Inc., Stamford, Conn.

[21] Appl. No.: 761,375

[22] Filed: Jan. 21, 1977

Related U.S. Application Data

[63] Continuation-in-part of Ser. No. 706,634, July 19, 1976, abandoned.

[51] Int. Cl.[2] ..... B65H 29/40

[52] U.S. Cl. ..... 271/176; 271/178; 271/212; 271/220

[58] Field of Search ..... 271/174, 176, 178, 220, 271/177, 80, 212

[56] References Cited

U.S. PATENT DOCUMENTS

| | | | |
|---|---|---|---|
| 1,991,028 | 2/1935 | Olson | 271/178 |
| 2,235,844 | 3/1941 | Nelson | 271/120 X |
| 3,744,649 | 7/1973 | Ward | 271/212 X |

*Primary Examiner*—Richard A. Schacher
*Attorney, Agent, or Firm*—Robert S. Salzman; William D. Soltow, Jr.; Albert W. Scribner

[57] ABSTRACT

A document feeding and stacking apparatus, which may be used in conjunction with a document delivery system, comprises a stacking station having a support platform and an edge aligning barrier projecting perpendicularly from one side of the platform. A document stack, having one side aligned with the barrier, is incrementally built on the platform by adding documents, one at a time, between the stack and platform. In order to do so, the stack is first pushed away from the platform surface and the next succeeding document to be added is then fed between the stack and platform by a planetary device which includes a rotatable spider member, at least one pusher roll mounted on the spider member for free rotation and at least one feed roll also mounted for rotation on the spider member. As the spider member is rotated, the pusher roll first projects through an opening in the support platform that is disposed adjacent to the stack. The pusher roll will push the document stack away from the platform surface to form an inlet gap for an incoming envelope. Immediately thereafter, the feed roll engages the next succeeding document delivered and feeds it between the stack and platform. The feed roll has a greater effective outer peripheral speed than the peripheral speed of the spider member because of its planetary motion with respect to the spider member. Operation of the planetary device is synchronized with the rate of document delivery from the system.

10 Claims, 2 Drawing Figures

28
28
L
26
S
10
E
G
16
18
16
64
22
20
58
36
38
40
24
50
48
56
52
B
12
E
66
B
34
46
54
60
32
A
44
30
42
INDEXING CONTROL
62

22
20
30
42
44
24
46
16
E
48
56
32
16
18
58
52
50
60
48
46
54
10
24
34
44
42
14
18
16
12

DOCUMENT FEEDING AND STACKING APPARATUS

This application is a continuation-in-part of U.S. application Ser. No. 706,634, filed July 19, 1976, and now abandoned.

BACKGROUND OF THE INVENTION

1. Field of the Invention

The present invention relates to an apparatus for feeding and stacking documents which may, for example, be used with particular advantage in mail handling systems for feeding and stacking envelopes.

At various steps in mail handling operations, individual pieces of mail are often collected and ordered in a stack. For example, after outgoing mail from a commercial or industrial business is sealed in envelopes that are imprinted or stamped with postage, the envelopes are collected in a stack to be deposited at an appropriate mail drop. Similarly, when the postage on the envelopes is cancelled at a post office, the envelopes are again stacked to be distributed according to their destination.

In moderate to large volume commercial, industrial, and postal mail handling applications, it is desirable to mechanize envelope stacking operations as a step toward achieving maximum efficiency.

There are, of course, many applications other than mail handling applications in which documents, such as simple paper sheets, are fed to and stacked at a collection station. The apparatus of the present invention may be adapted for these other applications also. Accordingly, as used in this specification and in the concluding claims, the term "document" is intended to mean, without limitation, any envelope, sheet, web, folder, or the like which is ordinarily thin, generally planar, and flexible.

DESCRIPTION OF THE PRIOR ART

Apparatus for feeding and stacking documents such as envelopes are know, but have been characterized by certain problems. As an example, one such apparatus includes an input document guide in the form of an elongated chute. A document collection platform is joined to the end of the chute to make a large obtuse angle, with the platform sloping away from the chute. A document edge aligning barrier is mounted perpendicularly to the collection platform at its end opposite its connection to the chute. The chute has length less than an average document. Therefore, a document resting on the platform having one edge abutting the alignment barrier will have an opposite edge and an adjoining portion which projects over the chute. When a succeeding document is fed along the chute, its leading edge will be projected under the stack of documents where it will join the stack.

Ordinarily stacked documents are urged by a weighted or spring loaded plate or by the force of gravity toward the collection platform. Therefore, it has been found that incoming documents may bind or bend when they impact the stack, either the stacked or incoming documents may tear, or the incoming documents may fail to fully enter the stack.

Other document stacking devices, such as those shown in U.S. Pat. Nos. 1,991,028 (Olson et al.) and 3,667,623 (Frazier et al.), are also known. The Olson et al. device includes a driven pusher wheel having a number of freely rotating antifriction rollers mounted at locations spaced from the axis of rotation of the pusher wheel. The antifriction rollers sequentially contact folded sheets as they are added to the stack to move these individual sheets into contact with an alignment table and further to move the entire stack up the table to make room for the next succeeding sheet. The Frazier et al. device includes a pusher plate which oscillates upwardly and downwardly in an orbital path to move a document stack upwardly and make room for a succeeding document to be added to a stack. The plate, through its orbital motion, also moves the last added document toward an edger plate to align the edge of each document as it is stacked.

Still other machines for feeding documents from a stack are disclosed in U.S. Pat. Nos. 2,764,409 (La Bombard) and 2,235,844 (Nelson). The La Bombard mechanism includes a drum having a series of closely spaced stack agitating rollers about its periphery and a single non-rotating sheet segregating element. The agitation of the stack breaks adhesion between the sheets in the stack so that the segregation element can pull one extreme sheet from the stack when the drum rotates. The Nelson device includes a rotating spider arrangement having three take-up rolls mounted at the periphery of a spider and driven with greater peripheral speed than the spider. Each take-up roll engages a sheet and pulls it from a stack against the influence of a friction hold-back shoe arrangement.

Neither the Nelson nor the La Bombard devices relates to a stacking mechanism, but rather, both relate to destacking mechanisms.

SUMMARY OF THE INVENTION

In a preferred embodiment, to be described below in detail, the document feeding and stacking apparatus of the present invention is designed for use with a document delivery system, such as a mechanized mail handling system, to form neat stacks of documents whether or not such documents are uniform in size. The apparatus prevents damage to documents during the stacking operation which has frequently resulted in operation of prior art apparatus. In particular, a gap or "window" in the stack is created by the apparatus for receiving the next succeeding document added to the stack. Accordingly, the added document can enter the stack without destructively impacting it. Further, the apparatus insures that the added document is thrust completely into the stack so that at least one of its edges is aligned with similarly situated edges of previously added documents.

In its preferred embodiment, the document feeding and stacking apparatus of the invention comprises a stacking station that has a stack support platform for receiving documents delivered by the system. The support platform has an opening which is disposed adjacent to the document stack location. As alignment barrier is mounted perpendicularly on one side of the support platform to align at least one edge of each document received thereon.

Document feed is performed by a planetary rotating spider device which pushes the stacked documents away from the platform to open a slight gap therebetween and immediately thereafter thrusts the next succeeding document into the gap until its leading edge abuts the alignment barrier. The spider device comprises a rotatable spider member, at least one pusher roll which is mounted for free rotation on the spider member to project through the platform opening, and at least one feed roll which is also mounted on the spider member to project through the platform opening. When the spider member is rotated, the pusher roll pushes the stack away from the platform to open the gap. The feed roll, which is arranged to rotate with a greater effective outer peripheral speed than the peripheral speed of the spider member, then engages a document delivered by the system and positively feeds it into the gap between the document stack and supporting platform. Operation of the spider member is synchronized with the rate at which documents are delivered by the system.

Thus, the apparatus of the present invention operates in rapid sequence to open a gap between the document stack and the platform on which the stack is supported and, immediately thereafter, to feed the next succeeding document into the stack. Document feed is positive and occurs with greater force than that which would result merely from delivery from the remainder of the system. Accordingly, the stack formed by the apparatus is neatly aligned at at least one side corresponding to similarly situated leading edges of the individual documents.

The apparatus of the present invention is simple, inexpensive to construct, and may be easily adapted to various types of document delivery systems. Accordingly, it is an object of the present invention to provide an apparatus which feeds and stacks documents such as envelopes, sheets of paper, and the like in an efficient yet economical manner.

Other objects, aspects and advantages of the present invention will be pointed out in, or will be understood from, the following detailed description provided below in conjunction with the accompanying drawings.

DETAILED DESCRIPTION OF THE PREFERRED EMBODIMENT

Figure 1:
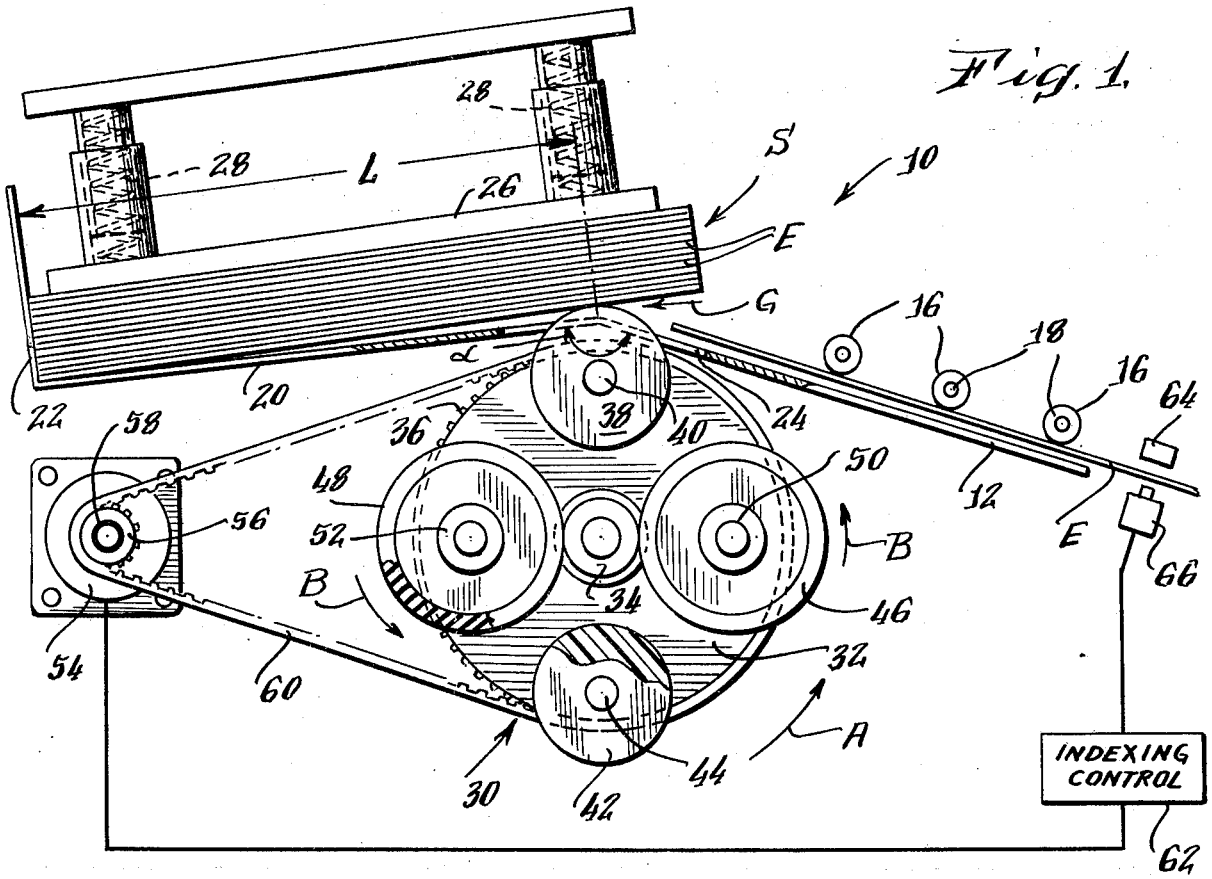
FIG. 1 is a top plan view of a diagrammatic representation of the document feeding and stacking apparatus of the present invention.
Figure 2:
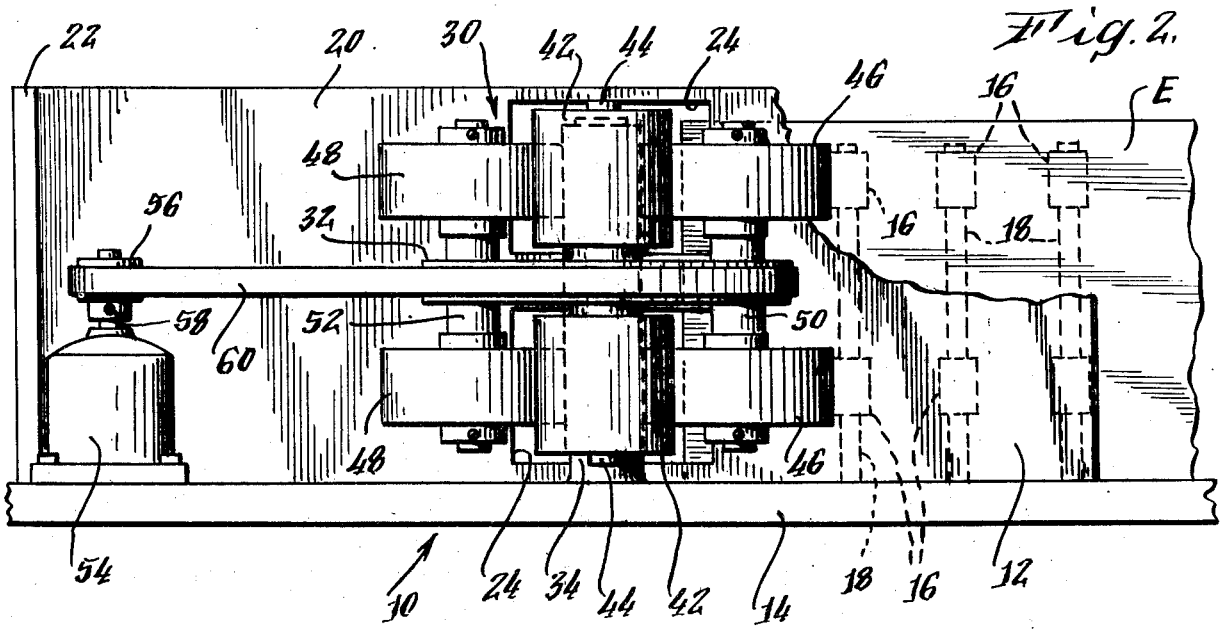
FIG. 2 is a side elevational view of this diagrammatic representation of the apparatus of the invention.

FIGS. 1 and 2 illustrate in diagrammatic form the basic components of the apparatus of the present invention, which is adapted for use with a document delivery system that may, for example, be a system for delivering envelopes E from a postage cancelling apparatus or a postage applying apparatus (not shown). However, the delivery system may be an envelope folding and sealing apparatus, a printing apparatus or any other machine which operates on documents of one type or another.

While FIGS. 1 and 2 generally represent the inventive apparatus as stacking material with a vertical orientation, it is to be understood that the inventive apparatus will work just as well with a different orientation, i.e. FIG. 1 can be a front view, and FIG. 2 can be a top or plan view. In other words, the invention can be so constructed and oriented to stack material horizontally, vertically, or any angle in between.

The apparatus, generally indicated at 10, includes a document input guide in the form of an input chute 12 mounted on a main frame which includes a single horizontally oriented lower frame 14 (FIG. 2). A series of input guide rolls 16 are mounted in spaced relation on shafts 18, cantilevered from frame 14, and are supported in spaced relation to the chute in order to guide an envelope E from the document delivery system. These guide rolls may be driven. However, if the envelope E is delivered with the sufficient momentum to travel along with entire length in input chute 12, rolls 16 need not be driven.

A document stack support platform 20, also mounted on frame 14, is connected directly to the input chute 12 and makes a large obtuse angle $\alpha$ therewith to slope sidewardly and away therefrom. However, platform 20 may extend linearly from chute 12 if desired. An alignment barrier 22 is mounted perpendicularly to the platform 20 at its end opposite that attached to the chute. As can be seen in FIG. 1, the platform 20 has length L which is shorter than the smallest document which is stacked thereon for reasons which will be described in greater detail below. Further, as can be seen in FIG. 2, both the input chute and document support platforms have openings 24 at their vertex which are disposed adjacent to the location of the document stack S formed on the platform.

As shown in FIG. 2, the envelopes E are delivered along the chute 12 and platform 20 with their lower edge in contact with the frame 14. As shown in FIG. 1, when they are assembled into stack S, their lead edges abut alignment barrier 22. Thus, the stack, formed in a manner described below, has at least two aligned sides.

A retaining plate 26 is mounted with the apparatus on compressed coiled springs 28 to urge the stack S toward platform 20.

The apparatus of the present invention further comprises a planetary spider assembly, generally indicated at 30, which is mounted to the side of input chute 12 and platform 20 enclosed by the angle $\alpha$. This spider assembly includes a spider member in the form of a disc 32 which is mounted on suitable antifriction bearings (not shown) on a non-rotatable shaft 34 which is cantilevered from the frame 14. The disc has a toothed or sprocketed periphery 36.

A first pair of pusher rolls 38 is carrier for free rotation on a shaft 40 which is mounted near the periphery of disc 32 and extends parallel to main shaft 34. An identical second pair of pusher rolls 42 is mounted for free rotation on a shaft 44 at a diametrically opposed, peripheral location on the disc. The pusher rolls are in this way located to move in an orbital path and project through the openings 24 in support platform 20 and input chute 12 when 32 is rotated. Moreover, each of the pusher rolls has an antifriction surface. For example, it has been found that rolls made from a material sold under the trade name Delrin are suitable.

The spider assembly 30 further comprises two pairs of feed rolls 46 and 48, each pair being mounted on shafts 50 and 52 respectively, that extend parallel to main shaft 34 at diametrically opposed positions. The feed rolls 46 and 48 have diameters and the shafts 50 and 52 are located so that each feed roll surface firmly contacts the main shaft 34, as shown in FIG. 1, and further projects through an opening 24 when disc 32 is rotated. Moreover, each feed roll has a surface made of high friction material such as rubber. Accordingly, when disc 32 is rotated in a counterclockwise direction as shown by arrow A in FIG. 1, each of the feed rolls move in an orbital path and also rotates in a counterclockwise direction as shown by arrows B but with greater peripheral speed than the peripheral speed at the disc.

Disc 32 is driven by a motor 54 mounted on frame 14 (FIG. 2). A toothed pulley or sprocket 56 is mounted on the motor shaft 58 and is interconnected with the toothed periphery 36 of disc 32 by a chain or toothed belt 60. Accordingly, the disc can be positively driven without slippage to move the feed and pusher rolls through their orbital paths.

The document feeding and stacking apparatus of the preferred embodiment of the present invention is incrementally operated by an indexing control 62 to feed to and stack envelopes on the document support platform 20 in the following manner. As an envelope approaches the apparatus on the input chute 12, it breaks a beam of light from a light source 64 which is directed toward a photocell 66 through a small hole in the chute. The signal generator by the interruption of this beam of light is conducted to the indexing control 62 which then starts motor 54 to rotate disc 32 at substantially the same linear speed as that of envelope E. The indexing control, controls the motor so that one pair of pusher rolls 38 or 42 (as the case may be) impacts the bottom envelope in the stack S at the proper time, as shown in FIG. 1, i.e. immediately prior to arrival of envelope E. This will result in pushing the entire stack away from the platform 20 and open a small gap G. The speed with which disc 32 rotates is such that the inertia of movement of the stack momentarily maintains the gap G between the stack and the support platform 20. The pusher rolls are free to rotate due to the normal rotation of the disc and the contract of the pusher rolls with the envelopes already in the stack. This action prevents distortion of the stacked envelopes since they are not further driven into the alignment barrier 22.

Further rotation of the disc 32 by the motor 54 engages the lead edge of an incoming envelope E on the surface of one pair of feed rolls 46 or 48. The rapid linear surface speed of the feed rolls then thrusts the lead edge of the envelope E into the stack while the gap G is open. The envelope E will eventually come into contact with the alignment barrier 22, to neatly align with one side of the stack. After document feeding and stacking has been completed, the motor stops spider assembly 30 at a rest position with the next pair of pusher rolls 38 or 42 (as the case may be) positioned to impact the stack S.

The apparatus described in detail above which includes an indexing control is adapted for operation with intermittent document delivery from the system. However, the apparatus may be adapted for continuous delivery of documents by synchronizing the continuous rotation of spider disc 32 driven by motor 54 with continuous rapid delivery of documents from the system.

It will be readily appreciated that the document feeding and stacking apparatus of the present invention is extremely simple yet effective in operation. It may be used to stack various forms of documents having uniform or non-uniform size efficiently and at high speed. The spider assembly need only be positioned to contact the shortest document to be stacked so that the entire stack is pushed away from the platform. Furthermore, the tendency of an entering envelope (or the envelope last added to the stack) to bind or be damaged by, for example, bending or tearing, is decreased by opening the gap G prior to insertion of the entering envelope.

Although a specific embodiment of the present invention has been described above in detail, it is to be understood that this is for purposes of illustration. Modifications may be made to the described document feeding and stacking apparatus by those skilled in the art in order to adapt this apparatus to particular application.

I claim:

1. A document feeding and stacking apparatus for use with a document delivery system for producing a stack of documents, said apparatus comprising:

A. a document stack support platform for receiving individual documents delivered by the system and having an opening therein which is disposed adjacent to the location at which the individual documents are to be stacked; and B. a planetary spider assembly including

1. a rotatable spider member;

2. at least one pusher roll mounted for free rotation on said spider member to project through said opening in said support platform for pushing a document stack away from said support platform when said spider member is rotated;

3. at least one feed roll also mounted on said spider member to, a. project through the opening in said support platform, b. engage a document delivered from the system, and c. feed a document under the stack while the stack is extended from said supporting platform as a result of the push of said pusher roll, when said spider member is rotated; and

4. means for rotating said feel roll with a greater effective outer peripheral speed than the peripheral speed of said spider member.

2. The document feeding and stacking apparatus as claimed in claim 1 wherein said pusher roll has an anti-friction peripheral surface to prevent adherence to said document stack.

3. The document feeding and stacking apparatus as claimed in claim 1 wherein said feed roll has a peripheral surface having a high coefficient of friction to firmly engage the surface of a document delivered thereto by the system.

4. The document feeding and stacking apparatus as claimed in claim 1 further comprising:

input guide means for delivering a document into positive engagement with said pushing and feeding means.

5. The document feeding and stacking apparatus as claimed in claim 1 wherein said means for rotating said feed roll with greater effective outer peripheral speed than the peripheral speed of said spider member comprises:

a non-rotatable shaft on which said spider member is mounted for rotation, said feed roll being rotatably mounted on said spider member with its peripheral surface engaging said non-rotatable shaft.

6. A document feeding and stacking apparatus for use with a document system for producing a stack of documents, said apparatus comprising:

A. a document stacking station having

1. a stack support platform for receiving individual documents delivered by the system and having an opening therein disposed adjacent to the location at which the individual documents are to be stacked; and

2. alignment means for aligning at least one edge of each document received on said platform;

B. a planetary spider assembly including

1. a rotatable spider member;

2. At least one pusher roll mounted for free rotation on said spider member to project through said opening in said support platform for pushing a document stack away from said support platform when said spider member is rotated;

3. at least one feed roll also mounted on said spider member to
   a. project through the opening in said support platform,
   b. engage a document delivered from the system, and
   c. feed a document under the stack while the stack is extended from said supporting platform as a result of the push of said pusher roll, when said spider member is rotated; and
4. means for rotating said feed roll with a greater effective outer peripheral speed than the peripheral speed of said spider member; and C. means for operating said planetary spider assembly in synchronism with delivery of documents by the system.

7. The document feeding and stacking apparatus as claimed in claim 6 wherein said means for rotating said feed roll with said greater effective outer peripheral speed than the peripheral speed of said spider member comprises:

a non-rotatable shaft on which said spider member is mounted for rotation, said feed roll being rotatably mounted on said spider member with its peripheral surface engaging said non-rotatable shaft.

8. The document feeding and stacking apparatus as claimed in claim 6 wherein said operating means comprises:

1. a motor for rotating said spider member; and
2. means for signaling said motor when a document is delivered to said apparatus by the system to rotate said spider means.

9. The document feeding and stacking apparatus as claimed in claim 6 wherein said signaling means comprises:

1. a photodetector; and
2. a light source focused on said photodetector across the path of document travel from the system.

10. The document feeding and stacking apparatus as claimed in claim 6 wherein said motor is coupled to said spider member to rotate its periphery at the same linear speed as that of documents delivered by the system.

* * * * *